US007255032B2

(12) United States Patent
Ho

(10) Patent No.: US 7,255,032 B2
(45) Date of Patent: Aug. 14, 2007

(54) PUNCHER HAVING REPLACEABLE KNIFE HOLDER

(75) Inventor: Chih-Kwo Ho, Hsin-Chuang (TW)

(73) Assignee: Ta Ta Office Products Inc., Taipei County (TW)

( * ) Notice: Subject to any disclaimer, the term of this patent is extended or adjusted under 35 U.S.C. 154(b) by 128 days.

(21) Appl. No.: 11/120,973

(22) Filed: May 4, 2005

(65) Prior Publication Data

US 2006/0249002 A1 Nov. 9, 2006

(51) Int. Cl.
*B26F 1/14* (2006.01)
*B26D 5/08* (2006.01)

(52) U.S. Cl. ..... 83/573; 83/627; 83/687; 83/691; 83/698.71

(58) Field of Classification Search ..... 83/687, 83/691, 627–635, 167, 571, 573, 618, 698.71, 83/698.91; 412/9, 11, 16; 234/38, 131; D18/34.8; D19/72
See application file for complete search history.

(56) References Cited

U.S. PATENT DOCUMENTS

| | | | | | |
|---|---|---|---|---|---|
| 3,921,487 | A * | 11/1975 | Otsuka et al. | ..... | 83/632 |
| 5,527,142 | A * | 6/1996 | Chih-Kwo | ..... | 412/16 |
| 5,575,188 | A * | 11/1996 | Hu | ..... | 83/167 |
| 5,771,768 | A * | 6/1998 | Malmstrom | ..... | 83/687 |
| 5,778,748 | A * | 7/1998 | Beijen | ..... | 83/628 |
| 6,047,623 | A * | 4/2000 | Whiteman et al. | ..... | 83/687 |
| 6,079,924 | A * | 6/2000 | Chiang | ..... | 83/633 |
| 6,363,826 | B1 * | 4/2002 | Whiteman et al. | ..... | 83/687 |
| 6,471,458 | B1 * | 10/2002 | Soule | ..... | 412/9 |
| 6,536,321 | B2 * | 3/2003 | Whiteman et al. | ..... | 83/618 |
| 6,688,199 | B2 * | 2/2004 | Godston et al. | ..... | 83/167 |
| 6,789,453 | B2 * | 9/2004 | Whiteman | ..... | 83/618 |
| 6,955,109 | B1 * | 10/2005 | Huang | ..... | 83/691 |
| 6,983,877 | B2 * | 1/2006 | Ko | ..... | 83/687 |
| 7,036,416 | B2 * | 5/2006 | Whiteman et al. | ..... | 83/687 |
| 7,096,552 | B1 * | 8/2006 | Ho | ..... | 412/33 |
| 7,143,675 | B2 * | 12/2006 | Chiang | ..... | 83/618 |
| 2004/0237748 | A1 * | 12/2004 | Potthoff et al. | ..... | 83/684 |
| 2005/0172775 | A1 * | 8/2005 | Lee | ..... | 83/687 |

* cited by examiner

*Primary Examiner*—Jason Prone
(74) *Attorney, Agent, or Firm*—Troxell Law Office, PLLC

(57) ABSTRACT

A puncher having a replaceable knife holder comprises a base, a knife holder, and a wastepaper-storing case. A cover is pivotally mounted in the front of the base. The front edge of the cover is extended to the knife-holding groove such that the knife-holding groove only provides the paper-only space for holding the paper. The paper is precisely punched by adjusting the adjusting knob mounted on a front panel of the cover. The knife holder is tightly fixed by a plurality of screwing knobs. A plurality of knives is mounted on a pressing plate that mounts on the backside of the knife holder. The knife holder is tightly fixed by the screwing knobs so the knife holder can be easily detached and replaced by another knife holder having different hole type and hole number. Besides, the cover also facilitates assembly and maintenance of the knife holder.

5 Claims, 5 Drawing Sheets

PUNCHER HAVING REPLACEABLE KNIFE HOLDER

FIELD OF THE INVENTION

The present invention relates to a puncher having a replaceable knife holder, and more particularly to a puncher in which the knife holder is tightly fixed by screwing the screwing knobs to facilitate the disassembly and maintenance of the knife holder. Thereupon the knife holder can be easily replaced by another knife holder having different hole type and hole number. Besides, the easily openable cover also facilitates assembly and maintenance of the knife holder.

BACKGROUND OF THE INVENTION

The general large-sized puncher is designed for punching documents and papers to staple them easily. However, the components of the conventional puncher are mounted inside a base so a tool must be applied to detach these components. It is very inconvenient to put this conventional puncher into practice. If it is desired to equip with different hole number, many time will be wasted on disassemble of the base. Accordingly, the adaptability of the conventional puncher needs to be improved.

SUMMARY OF THE INVENTION

It is a main object of the present invention to provide a puncher having a replaceable knife holder. The knife holder is inserted into the knife-holding groove of the base from a lateral portion of the knife-holding groove. After insertion, the knife holder is tightly fixed by a plurality of screwing knobs. Accordingly, the disassembly and maintenance of the knife holder is very easy, and it is very simple to dismount the knife holder or replace the knife holder with another knife holder having different hole type and hole number. Besides, the easily openable cover also facilitates assembly and maintenance of the knife holder.

Other objects and features of the present invention will become apparent from the following detailed description when taken in conjunction with the drawings in which:

DETAILED DESCRIPTION OF THE PREFERRED EMBODIMENT

The above-mentioned features and advantages of this invention, and the manner of attaining them, will become more apparent and the invention will be better understood by reference to the following description of embodiments of the invention taken in conjunction with the drawings.

Figure 1:
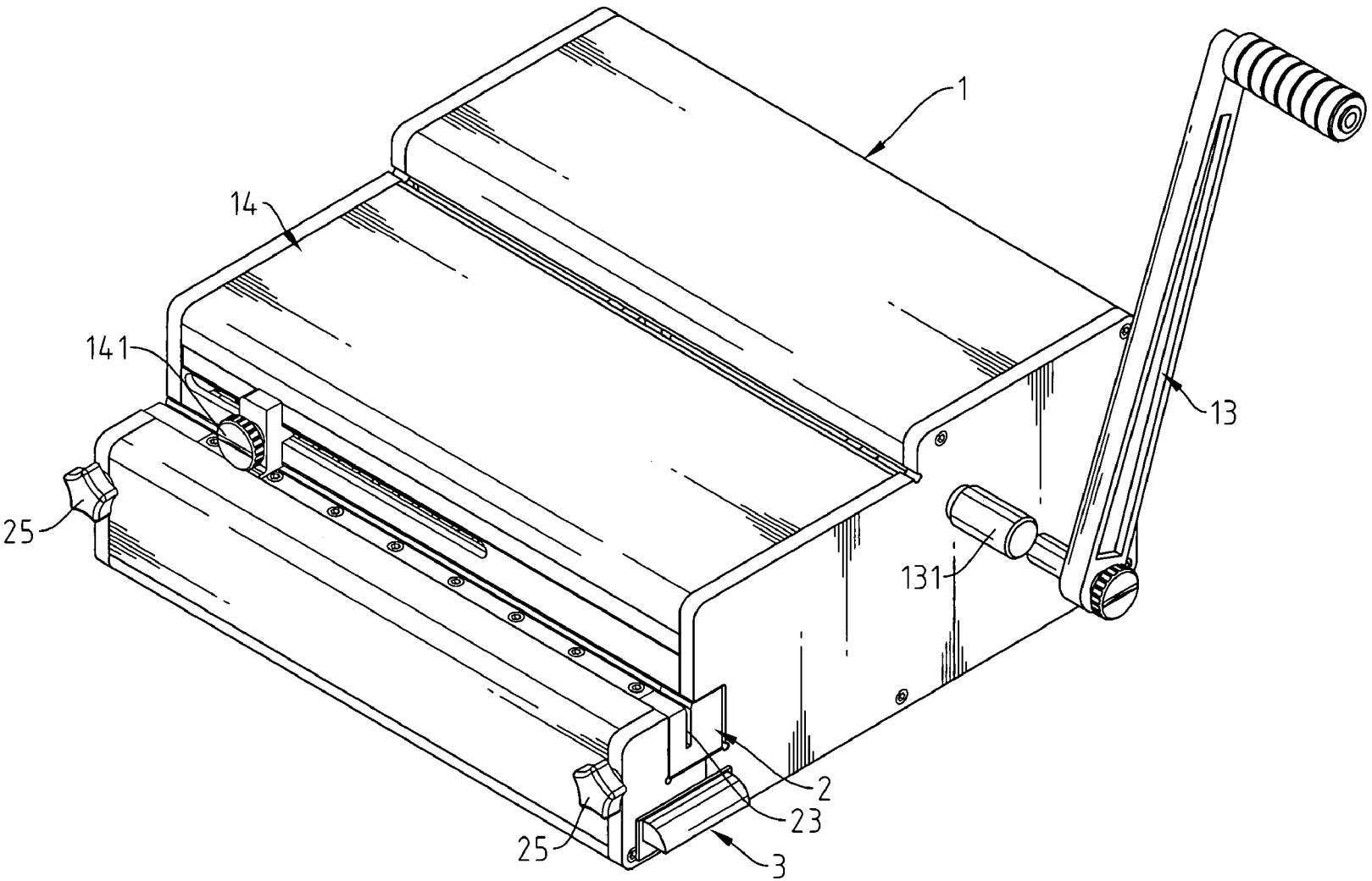
FIG. 1 is an elevational view showing the present invention.
Figure 2:
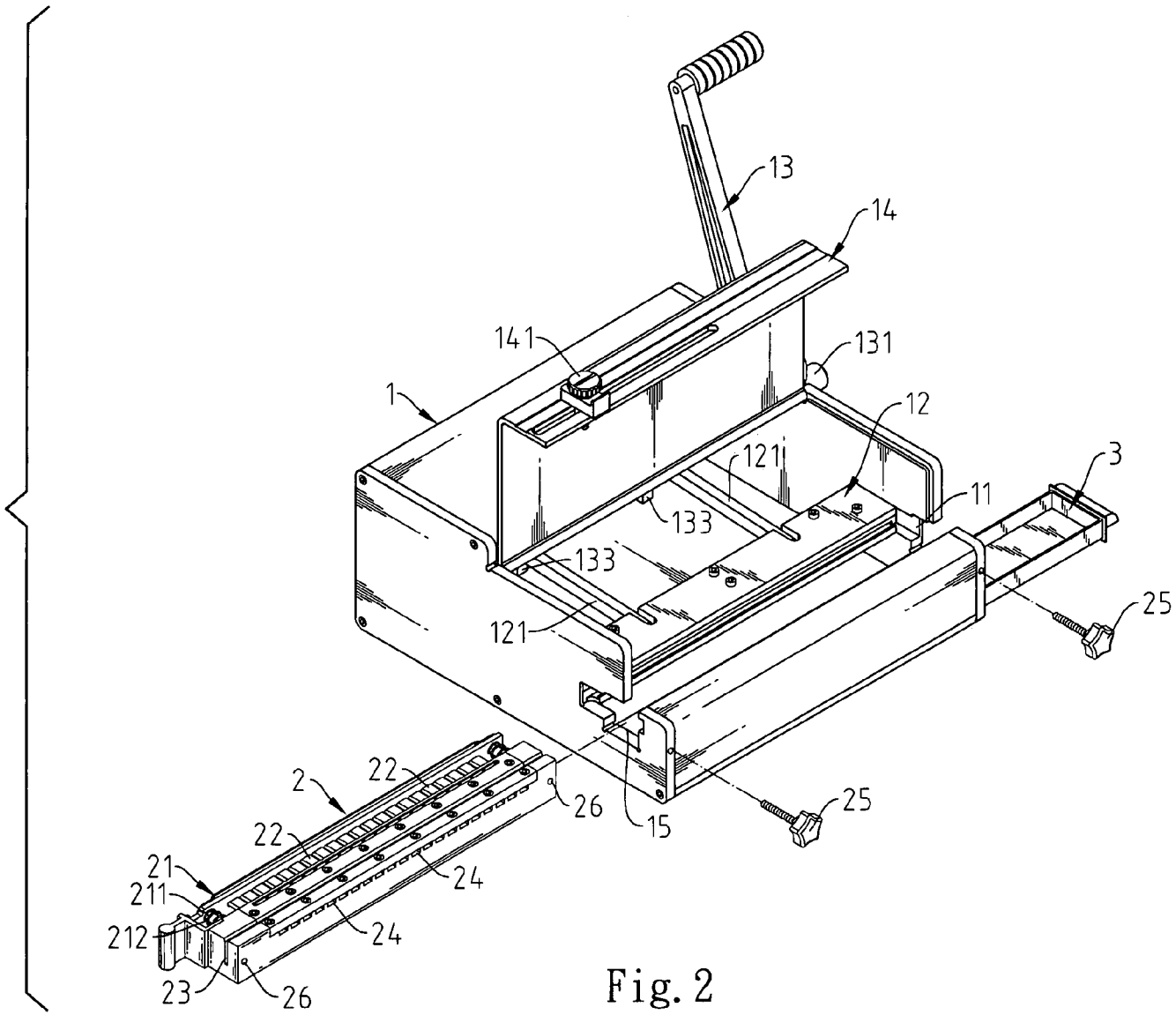
FIG. 2 is an elevational exploded view showing partial structure of the present invention.

Referring to FIG. 1 and FIG. 2, the present invention discloses a puncher having a replaceable knife holder. The puncher comprises a base 1, a knife holder 2, and a waste-paper-storing case 3. An inner trench 11 is formed on a lateral plate of the base 1 and located in the front of the base 1 for holding a pushing base 12, wherein a set of pushing rods 121 are connected with the backside of the pushing base 12. The pushing rods 121 are driven for motion when a pressing handle 13 is pressed downward. A rotating shaft 132 is mounted inside the base 1 and axially connected with the pressing handle 13. Because of the fixed pivotal connection between the pushing rods 121 and two connection blocks 133 mounted on the rotating shaft 132, when the pressing handle 13 is rotated and pressed down, the rotation of the rotating shaft 132 also allows the connection blocks 133 to forward drive the pushing rods 121 for moving the pushing base 12 along the inner trench 11. When the pressing handle 13 is pressed down to a given degree, the pressing handle 13 is blocked from downward moving by the stopper 131 that mounts in front of the pressing handle 13. Besides, a knife-holding groove 15 is formed in the front of the inner trench 11 for holding the knife holder 2.

A cover 14 is pivotally mounted in the front of the base 1, and the front edge of the cover 14 is such extended to the knife-holding groove 15 that the knife-holding groove 15 only provides the paper-only space for holding paper to protect the user from being hurt by the knife holder 2. Besides, an adjusting knob 141 is mounted on a front panel of the cover 14 for precisely punching the paper by adjusting the adjusting knob 141 in accordance with the size of the paper.

Figure 3:
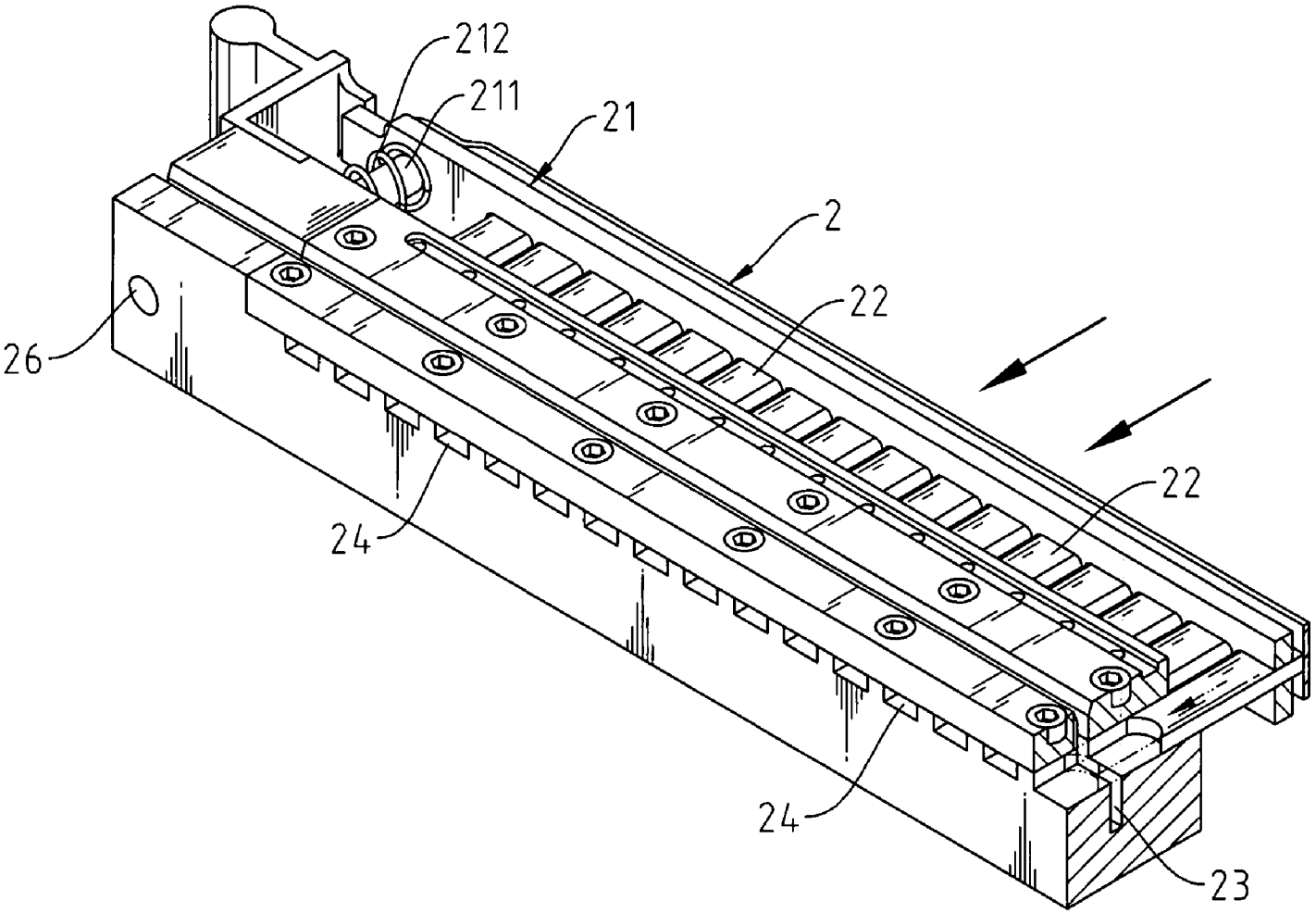
FIG. 3 is an elevational, sectional view showing partial knife holder of the present invention.

Referring to FIG. 2 and FIG. 3, the knife holder 2 is inserted into the knife-holding groove 15 of the base 1 from the lateral portion of the knife-holding groove 15. After insertion, the knife holder 2 is tightly fixed by inserting screwing knobs 25 into the knife holder 2 through fixing holes 26 formed on both sides of the housing of the base 1. Since the knife holder 2 is fixed by the screwing knobs 25, the knife holder 2 can be easily replaced by another knife holder 2 having different hole type and hole number. A plurality of knives 22 are mounted on a pressing plate 21 mounted on the backside of the knife holder 2. Each knife 22 is extended across the pressing plate 21, a paper-receiving groove 23, and wastepaper-withdrawing holes 24. The both ends of the pressing plate 21 are positioned by pillars 211. When the pressing plate 21 is pressed, it will move the knives 22 forward for punching.

Figure 4:
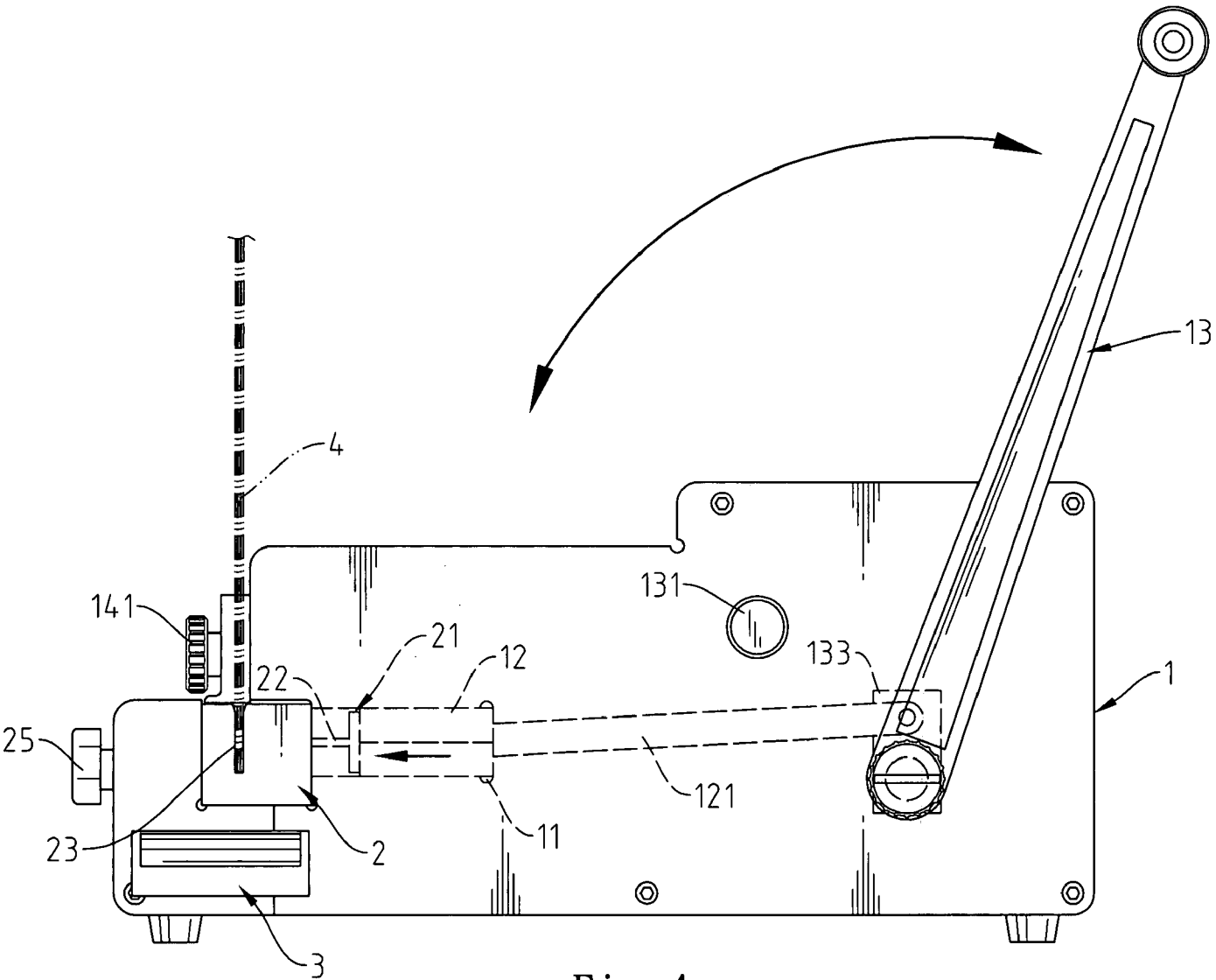
FIG. 4 is a schematic view showing the operation of punching the paper of the present invention.
Figure 5:
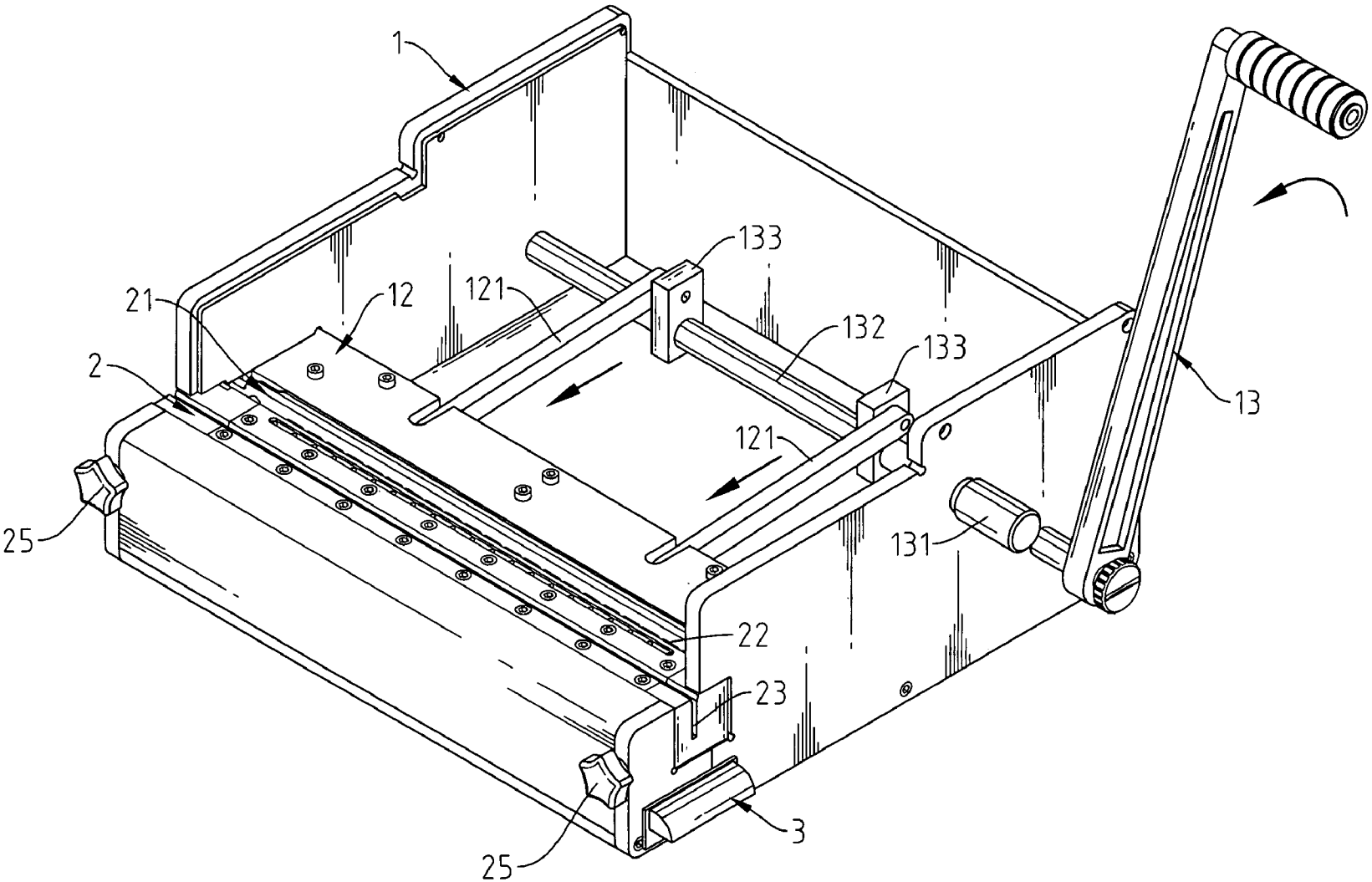
FIG. 5 is an elevational view showing the operation of punching the paper of the present invention.

Referring further to FIG. 2 and FIG. 4, if it is desired to punch the document or paper 4, the paper 4 is mounted in the paper-receiving groove 23, and thereafter the pressing handle 13 is pressed down to allow the pushing base 12 to forward push the knife holder 2. At this moment, the pressing plate 21 of the knife holder 2 pushes forward the knives 22 to punch the paper 4. If it is desired to push back the pressing handle 13, the force for recovering is provided by elastic devices 212, which are respectively sleeved onto the pillars 211 mounted on both sides of the pressing plate 21. After punching, the wastepapers are fallen from the wastepaper-withdrawing holes 24 into the wastepaper-storing case 3 mounted in the front lower portion of the base 1 for being swept away together.

On the basis of the description mentioned above, the knife holder of the puncher of the present invention can be replaced easily by another knife holder having different hole type and hole number by screwing or unscrewing the screwing knobs that fix the knife holder. Besides, the easily openable cover also provides the dual purposes of facilitating assembly and maintenance of the knife holder.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments, which do not depart from the spirit and scope of the invention.

What the invention claimed is:

1. A puncher comprising:

a) a base having:

i) two lateral sides, each of the two lateral sides having an inner trench;

ii) a pushing base slidably located in the inner trench of the two lateral sides;

iii) a knife-holding groove located on a front of the base and communicating with the inner trench of each of the two lateral sides;

iv) a rotating shaft rotatably located in the base;

v) two pushing rods, each of the two pushing rods is connected at a first end to a back of the pushing base;

vi) a pressing handle connected at one end thereof to the rotating shaft and movable between first and second positions, the pressing handle controlling the two pushing rods to move the pushing base between forward and rearward positions;

vii) two connection blocks fixedly connected to the rotating shaft, one of the two connection blocks are pivotally connected to a respective second end of the two pushing rods; and viii) a cover pivotally connected to the front of the base and movable between open and closed positions, when the cover is located in the closed position, the cover covering a predetermined portion of the knife-holding groove, the cover having an adjustment knob adjustably connected to a front of the cover; and b) a knife holder inserted into the knife-holding groove and having:

i) a pressing plate;

ii) a plurality of knives spaced across the pressing plate, the pressing plate is in communication with the pushing base and moves the plurality of knives forward for punching;

iii) a paper-receiving groove; and vi) a plurality of wastepaper-withdrawal holes communicating with the paper-receiving groove.

2. The puncher according to claim 1, further comprising two screwing knobs, the knife holder having two fixing holes, the knife holder is removably connected to the base by inserting the two screwing knobs through the base and threadedly connecting the two screwing knobs to the two fixing holes of the knife holder.

3. The puncher according to claim 1, further comprising a wastepaper-storing case removably inserted into the base and located below the knife holder.

4. The puncher according to claim 1, further comprising a stopper connected to the base and limiting a movement of the pressing handle.

5. The puncher according to claim 1, further comprising two elastic devices, the pressing plate having two pillars, the plurality of knives are located between the two pillars, the two elastic devices are located around a respective exterior of the two pillars.

* * * * *